US011857884B1

(12) United States Patent
Fletcher

(10) Patent No.: US 11,857,884 B1
(45) Date of Patent: Jan. 2, 2024

(54) MECHANICAL-MATHEMATICAL DIAGONAL NUMBER BOARD GAME

(71) Applicant: Joel Anthony Fletcher, Pittsburgh, PA (US)

(72) Inventor: Joel Anthony Fletcher, Pittsburgh, PA (US)

( * ) Notice: Subject to any disclaimer, the term of this patent is extended or adjusted under 35 U.S.C. 154(b) by 0 days.

(21) Appl. No.: 18/210,678

(22) Filed: Jun. 16, 2023

Related U.S. Application Data

(60) Provisional application No. 63/460,729, filed on Apr. 20, 2023.

(51) Int. Cl.
*A63F 3/04* (2006.01)
*A63F 3/00* (2006.01)

(52) U.S. Cl.
CPC ..... *A63F 3/0415* (2013.01); *A63F 3/00261* (2013.01); *A63F 3/00697* (2013.01); *A63F 3/00895* (2013.01); *A63F 2003/00347* (2013.01); *A63F 2003/00804* (2013.01); *A63F 2003/0418* (2013.01); *A63F 2250/1068* (2013.01)

(58) Field of Classification Search
CPC ..... A63F 3/0415; A63F 3/00261; A63F 3/00697; A63F 3/00895; A63F 2003/00347; A63F 2003/00804; A63F 2003/0418; A63F 2250/1068
See application file for complete search history.

(56) References Cited

U.S. PATENT DOCUMENTS 4,625,971 A * 12/1986 Ferguson ..... A63F 3/0423 273/272
4,850,595 A * 7/1989 Sherman ..... A63F 9/0098 273/272
5,871,210 A * 2/1999 Harrison ..... A63F 3/0423 273/272

(Continued)

*Primary Examiner* — Michael D Dennis
(74) *Attorney, Agent, or Firm* — Thomas M. Joseph, Esq.

(57) ABSTRACT

A game timer, a game board cartridge, and a plurality of game boards for inserting into the game board cartridge are provided. A play base has a plurality of grids and plurality of timer spots for receiving the game timer with each grid having a plurality of holding cells for receiving one of the plurality of numbered game tiles. A game board cartridge carrier for removeably holding the game board cartridge with the game board cartridge receives at least one of the plurality of game boards. A plurality of numbered game tiles with each of the plurality of tiles having playing tile indicia corresponding to an integer selected within the range of 0 to 9 is provided. The game board cartridge is positioned over the play base and can be rotated in relation thereto. Each of the plurality of game boards is marked with a game board grid having a plurality of rows and columns forming a plurality of squares, with each of the plurality of squares having a game board indicia corresponding to an integer selected within the range of 0 to 9, and with none of the integers repeating within the same row, same column, or with respect to a connecting diagonal square. The plurality of tiles are drawn during game play, so that a player can make a diagonal connection to score points by matching the playing tile indicia with the game board indicia during a predetermined time period measured by the game timer.

10 Claims, 18 Drawing Sheets

(56) References Cited

U.S. PATENT DOCUMENTS

| | | | | |
|---|---|---|---|---|
| 6,585,585 | B1 | 7/2003 | Fletcher | |
| 7,275,746 | B2 * | 10/2007 | Jensen | A63F 3/04 273/272 |
| 7,677,564 | B2 * | 3/2010 | Kriger | A63F 3/0415 273/153 R |
| 10,124,243 | B1 * | 11/2018 | Baugh | A63F 3/0423 |
| 2007/0108701 | A1 * | 5/2007 | Gu | A63F 9/1204 273/153 R |
| 2009/0278311 | A1 * | 11/2009 | Bower | A63F 3/0415 273/242 |
| 2018/0229106 | A1 * | 8/2018 | Mathews | A63F 3/0415 |
| 2020/0197788 | A1 * | 6/2020 | Wang | A63F 3/0415 |

* cited by examiner

800

| DIAGNUM SCORE BOARD | | | | | |
|---|---|---|---|---|---|
| POINTS | D | I | A | G | POINTS |
| 10 | | | | | 10 |
| 20 | | | | | 20 |
| 30 | | | | | 30 |
| 40 | | | | | 40 |
| 50 | | | | | 50 |
| 60 | | | | | 60 |
| 70 | | | | | 70 |
| 80 | | | | | 80 |
| 90 | | | | | 90 |
| START | D | I | A | G | START |
| 1 | | | | | 1 |
| 2 | | | | | 2 |
| 3 | | | | | 3 |
| 4 | | | | | 4 |
| 5 | | | | | 5 |
| 6 | | | | | 6 |
| 7 | | | | | 7 |
| 8 | | | | | 8 |
| 9 | | | | | 9 |
| POINTS | D | I | A | G | POINTS |

FIG. 8

| | | | | | | |
|---|---|---|---|---|---|---|
| 0 | 3 | 9 | 5 | 7 | 1 | 4 |
| 5 | | 7 | | 3 | | 9 |
| 7 | 9 | 3 | 5 | 8 | 6 | 2 |
| 4 | | 0 | | 1 | | 0 |
| 1 | 8 | 2 | 7 | 4 | 6 | 3 |
| 6 | | 5 | | 2 | | 8 |
| 2 | 8 | 1 | 9 | 0 | 4 | 6 |

FIG. 9a

| | | | | | | |
|---|---|---|---|---|---|---|
| 0 | 3 | 9 | 5 | 7 | 1 | 4 |
| 5 | | 7 | | 3 | | 9 |
| 7 | 9 | 3 | 5 | 8 | 6 | 2 |
| 4 | | 0 | | 1 | | 0 |
| 1 | 8 | 2 | 7 | 4 | 6 | 3 |
| 6 | | 5 | | 2 | | 8 |
| 2 | 8 | 1 | 9 | 0 | 4 | 6 |

FIG. 9b

| | | | | | | |
|---|---|---|---|---|---|---|
| 1 | 5 | 9 | 2 | 6 | 0 | 7 |
| 3 | | 7 | | 4 | | 2 |
| 7 | 0 | 4 | 9 | 1 | 6 | 8 |
| 9 | | 6 | | 3 | | 3 |
| 4 | 1 | 3 | 9 | 0 | 8 | 5 |
| 8 | | 5 | | 2 | | 1 |
| 6 | 0 | 2 | 7 | 5 | 8 | 4 |

FIG. 9c

| | | | | | | |
|---|---|---|---|---|---|---|
| 1 | 5 | 9 | 2 | 6 | 0 | 7 |
| 3 | | 7 | | 4 | | 2 |
| 7 | 0 | 4 | 9 | 1 | 6 | 8 |
| 9 | | 6 | | 3 | | 3 |
| 4 | 1 | 3 | 9 | 0 | 8 | 5 |
| 8 | | 5 | | 2 | | 1 |
| 6 | 0 | 2 | 7 | 5 | 8 | 4 |

FIG. 9d

| | | | | | | |
|---|---|---|---|---|---|---|
| 2 | 4 | 7 | 0 | 5 | 9 | 1 |
| 8 | | 2 | | 7 | | 4 |
| 4 | 6 | 8 | 5 | 3 | 1 | 9 |
| 1 | | 3 | | 9 | | 6 |
| 6 | 8 | 1 | 7 | 2 | 0 | 3 |
| 0 | | 5 | | 4 | | 8 |
| 7 | 3 | 9 | 2 | 6 | 0 | 5 |

FIG. 9e

| | | | | | | |
|---|---|---|---|---|---|---|
| 2 | 4 | 7 | 0 | 5 | 9 | 1 |
| 8 | | 2 | | 7 | | 4 |
| 4 | 6 | 8 | 5 | 3 | 1 | 9 |
| 1 | | 3 | | 9 | | 6 |
| 6 | 8 | 1 | 7 | 2 | 0 | 3 |
| 0 | | 5 | | 4 | | 8 |
| 7 | 3 | 9 | 2 | 6 | 0 | 5 |

FIG. 9f

| | | | | | | |
|---|---|---|---|---|---|---|
| 3 | 8 | 6 | 9 | 7 | 1 | 4 |
| 1 | | 1 | | 5 | | 8 |
| 5 | 8 | 3 | 7 | 2 | 0 | 6 |
| 2 | | 0 | | 4 | | 2 |
| 6 | 4 | 7 | 2 | 8 | 0 | 5 |
| 9 | | 9 | | 6 | | 3 |
| 4 | 7 | 5 | 3 | 1 | 9 | 0 |

FIG. 9g

| | | | | | | |
|---|---|---|---|---|---|---|
| 3 | 8 | 6 | 9 | 7 | 1 | 4 |
| 1 | | 1 | | 5 | | 8 |
| 5 | 8 | 3 | 7 | 2 | 0 | 6 |
| 2 | | 0 | | 4 | | 2 |
| 6 | 4 | 7 | 2 | 8 | 0 | 5 |
| 9 | | 9 | | 6 | | 3 |
| 4 | 7 | 5 | 3 | 1 | 9 | 0 |

FIG. 9h

| | | | | | | |
|---|---|---|---|---|---|---|
| 4 | 9 | 0 | 2 | 7 | 3 | 5 |
| 2 | | 6 | | 9 | | 9 |
| 5 | 0 | 8 | 2 | 6 | 4 | 1 |
| 3 | | 4 | | 0 | | 7 |
| 6 | 8 | 1 | 7 | 3 | 5 | 2 |
| 1 | | 5 | | 1 | | 8 |
| 8 | 3 | 7 | 9 | 4 | 6 | 0 |

FIG. 9i

| | | | | | | |
|---|---|---|---|---|---|---|
| 4 | 9 | 0 | 2 | 7 | 3 | 5 |
| 2 | | 6 | | 9 | | 9 |
| 5 | 0 | 8 | 2 | 6 | 4 | 1 |
| 3 | | 4 | | 0 | | 7 |
| 6 | 8 | 1 | 7 | 3 | 5 | 2 |
| 1 | | 5 | | 1 | | 8 |
| 8 | 3 | 7 | 9 | 4 | 6 | 0 |

FIG. 9j

| | | | | | | |
|---|---|---|---|---|---|---|
| 5 | 2 | 4 | 0 | 3 | 7 | 9 |
| 7 | | 6 | | 5 | | 0 |
| 4 | 1 | 8 | 0 | 7 | 3 | 6 |
| 9 | | 3 | | 9 | | 1 |
| 3 | 6 | 9 | 5 | 1 | 4 | 8 |
| 1 | | 2 | | 8 | | 2 |
| 6 | 8 | 5 | 0 | 2 | 4 | 1 |

FIG. 9k

| | | | | | | |
|---|---|---|---|---|---|---|
| 5 | 2 | 4 | 0 | 3 | 7 | 9 |
| 7 | | 6 | | 5 | | 0 |
| 4 | 1 | 8 | 0 | 7 | 3 | 6 |
| 9 | | 3 | | 9 | | 1 |
| 3 | 6 | 9 | 5 | 1 | 4 | 8 |
| 1 | | 2 | | 8 | | 2 |
| 6 | 8 | 5 | 0 | 2 | 4 | 1 |

FIG. 9l

| | | | | | | |
|---|---|---|---|---|---|---|
| 6 | 3 | 8 | 1 | 9 | 2 | 4 |
| 1 | | 5 | | 4 | | 8 |
| 7 | 3 | 9 | 1 | 8 | 2 | 5 |
| 0 | | 6 | | 6 | | 0 |
| 5 | 3 | 0 | 9 | 1 | 4 | 6 |
| 8 | | 7 | | 7 | | 2 |
| 4 | 0 | 2 | 9 | 3 | 5 | 7 |

FIG. 9m

| | | | | | | |
|---|---|---|---|---|---|---|
| 6 | 3 | 8 | 1 | 9 | 2 | 4 |
| 1 | | 5 | | 4 | | 8 |
| 7 | 3 | 9 | 1 | 8 | 2 | 5 |
| 0 | | 6 | | 6 | | 0 |
| 5 | 3 | 0 | 9 | 1 | 4 | 6 |
| 8 | | 7 | | 7 | | 2 |
| 4 | 0 | 2 | 9 | 3 | 5 | 7 |

FIG. 9n

| | | | | | | |
|---|---|---|---|---|---|---|
| 7 | 2 | 8 | 4 | 1 | 3 | 6 |
| 5 | | 6 | | 9 | | 0 |
| 2 | 0 | 4 | 1 | 7 | 5 | 8 |
| 8 | | 7 | | 3 | | 3 |
| 4 | 2 | 5 | 1 | 6 | 0 | 9 |
| 0 | | 9 | | 4 | | 5 |
| 9 | 6 | 3 | 1 | 8 | 2 | 7 |

FIG. 9o

| | | | | | | |
|---|---|---|---|---|---|---|
| 7 | 2 | 8 | 4 | 1 | 3 | 6 |
| 5 | | 6 | | 9 | | 0 |
| 2 | 0 | 4 | 1 | 7 | 5 | 8 |
| 8 | | 7 | | 3 | | 3 |
| 4 | 2 | 5 | 1 | 6 | 0 | 9 |
| 0 | | 9 | | 4 | | 5 |
| 9 | 6 | 3 | 1 | 8 | 2 | 7 |

FIG. 9p

| | | | | | | |
|---|---|---|---|---|---|---|
| 8 | 1 | 3 | 5 | 2 | 0 | 6 |
| 4 | | 7 | | 8 | | 4 |
| 7 | 9 | 2 | 4 | 1 | 6 | 8 |
| 0 | | 6 | | 9 | | 2 |
| 5 | 3 | 8 | 1 | 4 | 0 | 7 |
| 9 | | 9 | | 7 | | 3 |
| 6 | 2 | 0 | 9 | 3 | 5 | 1 |

FIG. 9q

| | | | | | | |
|---|---|---|---|---|---|---|
| 8 | 1 | 3 | 5 | 2 | 0 | 6 |
| 4 | | 7 | | 8 | | 4 |
| 7 | 9 | 2 | 4 | 1 | 6 | 8 |
| 0 | | 6 | | 9 | | 2 |
| 5 | 3 | 8 | 1 | 4 | 0 | 7 |
| 9 | | 9 | | 7 | | 3 |
| 6 | 2 | 0 | 9 | 3 | 5 | 1 |

FIG. 9r

| | | | | | | |
|---|---|---|---|---|---|---|
| 9 | 1 | 8 | 2 | 5 | 3 | 7 |
| 5 | | 5 | | 0 | | 9 |
| 7 | 1 | 9 | 2 | 8 | 6 | 4 |
| 3 | | 4 | | 4 | | 1 |
| 0 | 8 | 2 | 7 | 1 | 6 | 3 |
| 6 | | 0 | | 3 | | 8 |
| 4 | 2 | 7 | 5 | 9 | 6 | 0 |

FIG. 9s

| | | | | | | |
|---|---|---|---|---|---|---|
| 9 | 1 | 8 | 2 | 5 | 3 | 7 |
| 5 | | 5 | | 0 | | 9 |
| 7 | 1 | 9 | 2 | 8 | 6 | 4 |
| 3 | | 4 | | 4 | | 1 |
| 0 | 8 | 2 | 7 | 1 | 6 | 3 |
| 6 | | 0 | | 3 | | 8 |
| 4 | 2 | 7 | 5 | 9 | 6 | 0 |

FIG. 9t

| | | | | | | |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | 32 | 33 | 34 | 35 |
| 36 | 37 | 38 | 39 | 40 | 41 | 42 |
| 43 | 44 | 45 | 46 | 47 | 48 | 49 |

FIG. 11a

| | | | | | | |
|---|---|---|---|---|---|---|
| 6 | 3 | 8 | 1 | 9 | 2 | 4 |
| 1 | | 5 | | 4 | | 8 |
| 7 | 3 | 9 | 1 | 8 | 2 | 5 |
| 0 | | 6 | | 6 | | 0 |
| 5 | 3 | 0 | 9 | 1 | 4 | 6 |
| 8 | | 7 | | 7 | | 2 |
| 4 | 0 | 2 | 9 | 3 | 5 | 7 |

FIG. 11b

MECHANICAL-MATHEMATICAL DIAGONAL NUMBER BOARD GAME

CROSS REFERENCE TO RELATED APPLICATION

This application claims the benefit under 35 U.S.C. § 119(e) of U.S. Provisional Application No. 63/460,729 entitled "MECHANICAL-MATHEMATICAL DIAGONAL NUMBER BOARD GAME" filed Apr. 20, 2023, which is incorporated herein by reference.

BACKGROUND

Board games are tabletop games that typically use pieces. These pieces are moved or placed on a pre-marked board (playing surface) and often include elements of table, card, role-playing, and miniatures games as well. Board games are said to be one of the most favorite family past times around the world, especially board games that provide players with a competitive challenge.

Classic competitive board games, like chess and checkers, have different game rules and, generally, include stationary, flat surface boards with similar game board patterns and colors. Both chess and checkers are two-player games. Other classic competitive board games, like MONOPOLY® and RISK® can be played by more players. MONOPOLY® and RISK® are registered trademarks of Hasbro, Inc. of Pawtucket, Rhode Island.

The late 1990s onwards have seen substantial growth in the reach and market of board games. This has been attributed to, among other factors, the Internet, which has made it easier for people to find out about games and to find opponents to play against, as well as with a general increase in leisure time and consumer spending on entertainment. This trend has continued in the 2000s with the late 2010s being referred to as a new Golden Age of board games or as a renaissance.

Many newer, numeric board games, such as the newly popular board game SUDOKU®, can be played on a stationary flat surface board and can be played by as many as nine players at a time. SUDOKU® is a registered trademark of Red Key Software Corporation of White Plains, New York.

The SUDOKU® board game includes a predetermined number of receptacles organized in rows, columns, and boxes and is initialized by placing markers on the game board in a specific fashion in said markers. Distinct markers are distributed to each player and play progresses in turn by each player placing a marker on the game board such that each row, column, and box does not contain two identical markers. The object of the board game is for a player to play as many of their markers as possible. The player who plays the most markers first win the game.

The above-described board games have many features, but board game players always enjoy new challenges. As a result, there is a need for a time-based mathematical tabletop family fun number board game for four players ten years old and up. Such a game would be designed to enhance a player's concentration, logic, and mathematical calculating abilities.

COPYRIGHT STATEMENT

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a system for a mechanical-mathematical diagonal number board game includes a game timer, a game board cartridge, and a plurality of game boards for inserting into the game board cartridge. A play base has a plurality of grids and plurality of timer spots for receiving the game timer with each grid having a plurality of holding cells for receiving one of the plurality of numbered game tiles. A game board cartridge carrier for removeably holding the game board cartridge with the game board cartridge receives at least one of the plurality of game boards. A plurality of numbered game tiles with each of the plurality of tiles having playing tile indicia corresponding to an integer selected within the range of 0 to 9 is provided. The game board cartridge is positioned over the play base and can be rotated in relation thereto. Each of the plurality of game boards is marked with a game board grid having a plurality of rows and columns forming a plurality of squares, with each of the plurality of squares having a game board indicia corresponding to an integer selected within the range of 0 to 9, and with none of the integers repeating within the same row, same column, or with respect to a connecting diagonal square. The plurality of tiles are drawn during game play, so that a player can make a diagonal connection to score points by matching the playing tile indicia with the game board indicia during a predetermined time period measured by the game timer.

In other implementations, a method of playing a mechanical-mathematical diagonal number board game is provided. One of four players is oriented on a side of a square shaped board game base. Each of the four players is prompted to draw one of at least 40 game tiles from a shaker bag with each of the game tiles having a number selected from a group of numbers from 0 to 9 on a game board and being configured to insert into a game board cartridge mounted on a mechanical swivel device located at center of the square shaped board game base. At least one game action selected from a group consisting of a play-move action, a score-call action, a catching-call action, a recovery-call action, and a passing action is made. The game board is marked with a 7 square by 7 square grid, wherein each of the 7 square by 7 square grid aligns with the game board cartridge grid and is marked with a number selected from a group of numbers from 0 to 9, wherein the number does not repeat in another grid on a same row, column, or diagonal on the 7 square by 7 square grid. The play-move action includes placing one of the at least 40 game tiles on the game board. The score-call action includes announcing a score point with the score point including a sum of differences of numbers between at least two of the game tiles connected diagonally on the game board cartridge. The catch-call action includes identifying any differences between the score point and the sum of differences of numbers between at least two of the game tiles connected diagonally on the game board cartridge, made by another player during a previous score-call actions, and accumulating the differences on the score point. Recovery-call action are used at times when a game tile is discovered sitting atop a different number than itself or sitting on in a black (unusable) space after a full round of play, thus the placement of the tile is considered a play move violation. The game tile called out during the recovery-call action is returned to the shaker bag. The passing action includes taking no action. The score points of each of the four players is compared after all of the at least 40 game tiles are withdrawn from the shaker bag.

These and other features and advantages will be apparent from a reading of the following detailed description and a review of the appended drawings. It is to be understood that the foregoing summary, the following detailed description and the appended drawings are explanatory only and are not restrictive of various aspects as claimed.

BRIEF DESCRIPTION OF THE DRAWINGS

FIG. 8 illustrates a top view of a quad-play DIAGNUM scoreboard in accordance with the disclosure.

FIGS. 9*a*-9*t* illustrate a top view of a two-sided interchangeable diagonal number game board set in accordance with the disclosure.

FIG. 11*a* illustrates a game board grid space position numbers in accordance with the disclosure.

FIG. 11*b* illustrates a game player's first pyramid number piece placements onto the game board in accordance with the disclosure.

DETAILED DESCRIPTION

Figure 1A:
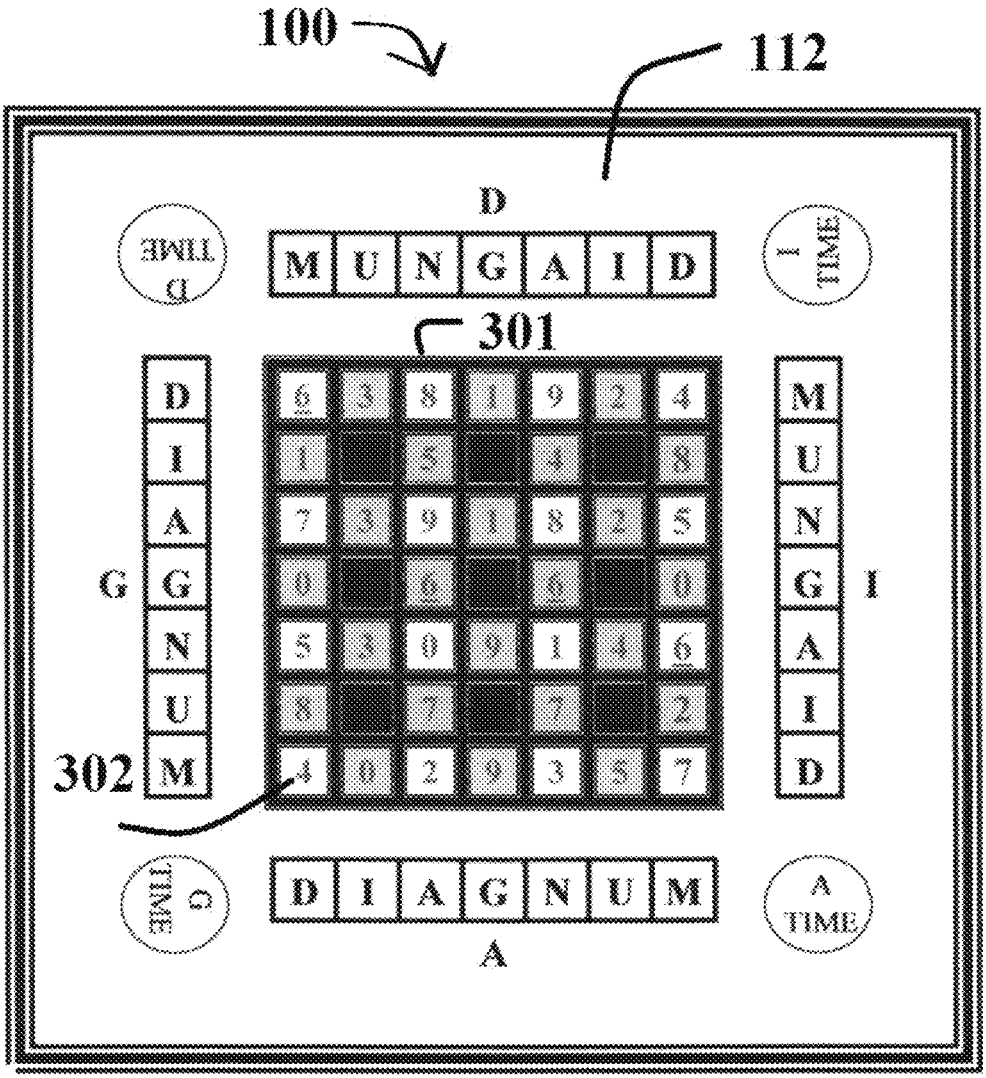
FIG. 1*a* illustrates a top view of the full assembly of a mechanical-mathematical diagonal number board game in accordance with the disclosure.

The subject disclosure is directed to a mechanical-mathematical diagonal number board game. The game is conducted by placing game pieces according to the configuration of the game board, wherein each player uses mathematical skills to deduce the amount of points available with each move. Each player is also encouraged to keep track of other players' performances in order to maximize their own score accumulation.

The game is intended to have a number of pre-configured board pieces that vary in difficulty, and players can set up multiple player sessions of varying difficulty with one game system. The game is played with a set of rules that uses subtraction between adjacent diagonal connecting single digit number pieces combined with the mathematical addition of their sum differences to score game points and win.

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

The subject disclosure is directed to board games and, more specifically, to competitive mathematical board games. The board game is a mechanical-mathematical diagonal number board game with multiple-colored boards that is played with a set of rules that uses single digit subtraction between adjacent diagonal connecting game board number pieces.

Then, the sum differences are added together to score game points to win. The first player who reaches the DIAGNUM score of 99 points win the game. A set of ten two-sided Interchangeable multicolor diagonal number game boards are incorporated with this invention that are inserted into a game board cartridge riding atop a game board cartridge carrier.

Optionally, a mechanical swivel device is used to aid the players with visual clarity of the printed game board numbers when swiveled around. The mechanical swivel device rotates 360 degrees giving a front-face-view of the printed numbers on the game board. Stand-alone game board pyramid number pieces (PNP's) are illustrated as being the ideal game board number piece (GNP) for the game. A shaker bag is used for withdrawing the PNPs out for game play and storing them away at the end of the game. A tabletop quad-person scoreboard, scoreboard twin scoring pins, and a 30-second sand timer is also disclosed.

In one exemplary embodiment of the mechanical-mathematical diagonal number board game, the system comprises a board game play base that is square shaped, comprising a number piece holding cell oriented alongside each side of the board game play base and a timer spot oriented at each corner of the board game play base, wherein each number piece holding cell is situated at a designated letter position.

The system also includes a mechanical swivel device located at center of the board game play base, a game board cartridge carrier comprising a game board cartridge base and a game board grid, and a game board cartridge marked with a 7 square by 7 square grids, configured to insert into the game board cartridge carrier. The game board is designed so that each of the 7 square by 7 square grids aligns with the game board grids and is marked with a number selected from a group of numbers from 0 to 9, wherein the number does not repeat in another grid on a same row, column, or diagonal on the 7 square by 7 square grid.

The board game system comprises at least 40 pyramid number pieces, each pyramid number piece comprises a number selected from a group of numbers from 0 to 9, wherein each pyramid number piece is configured to align with each of the 7 square by 7 square grids.

The mathematical board game can be conducted by placing each of the 40 pyramid number pieces on one of the 7 square by 7 square grid, and can accumulate a score point, wherein the score point comprises a sum of differences of numbers between at least two of the pyramid number pieces connected diagonally on the game board cartridge, wherein the board game is decided by the score point.

Figure 1B:
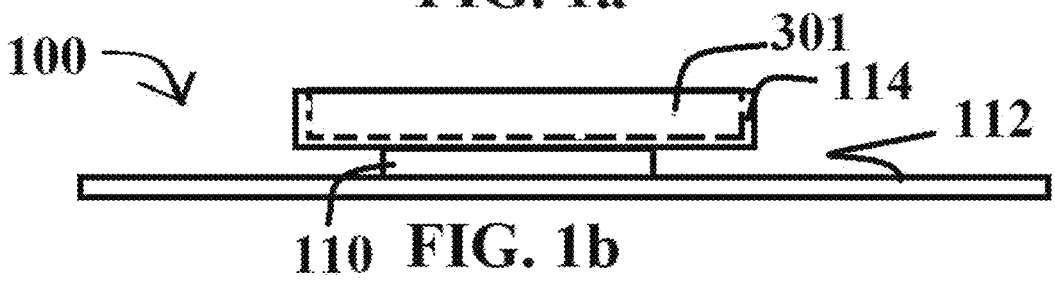
FIG. 1B illustrates a side view of the board game assembly shown in FIG. 1*a*.
Figure 1C:
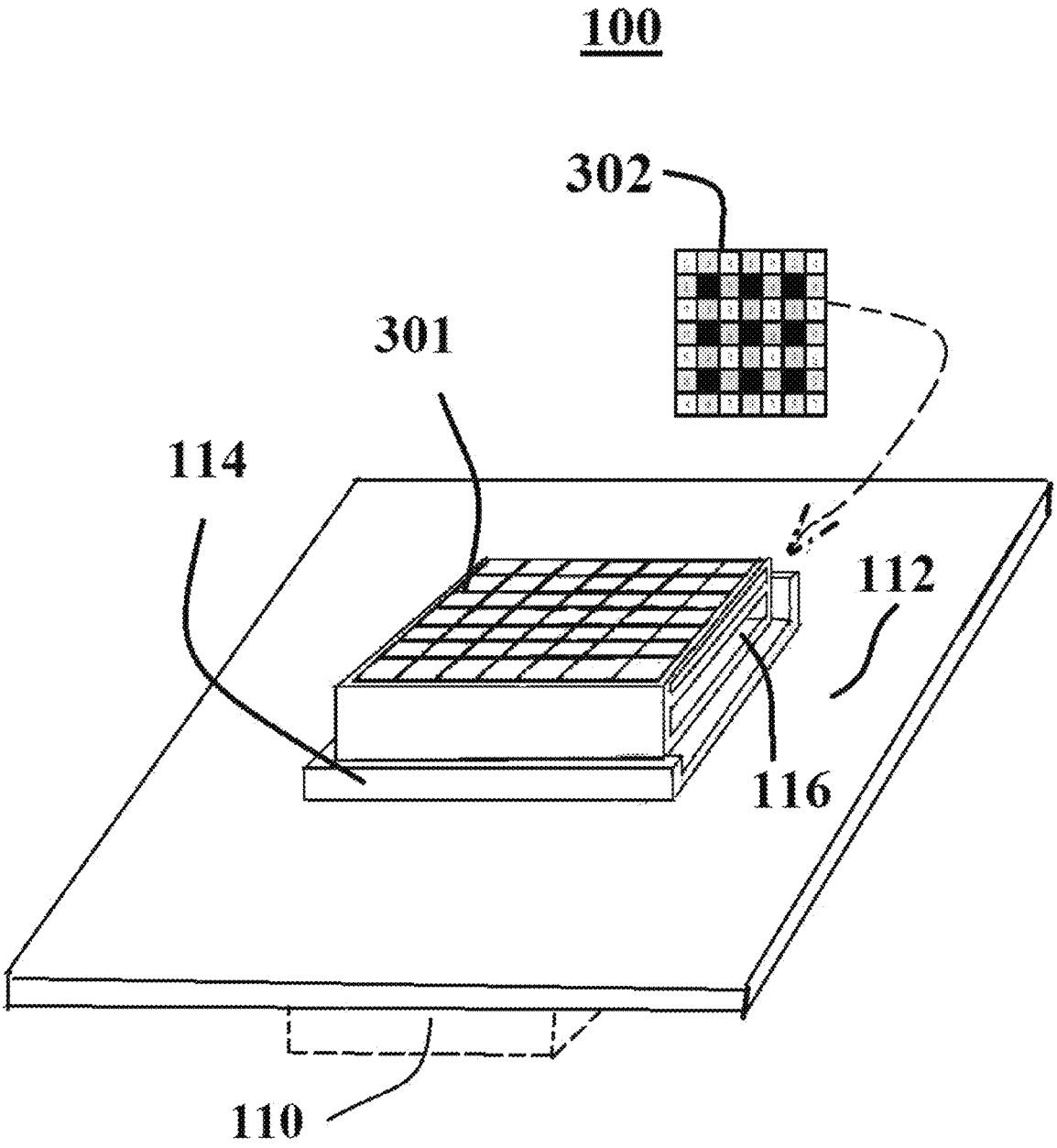
FIG. 1*c* illustrates a perspective view of the board game assembly shown in FIG. 1*a*.
Figure 2:
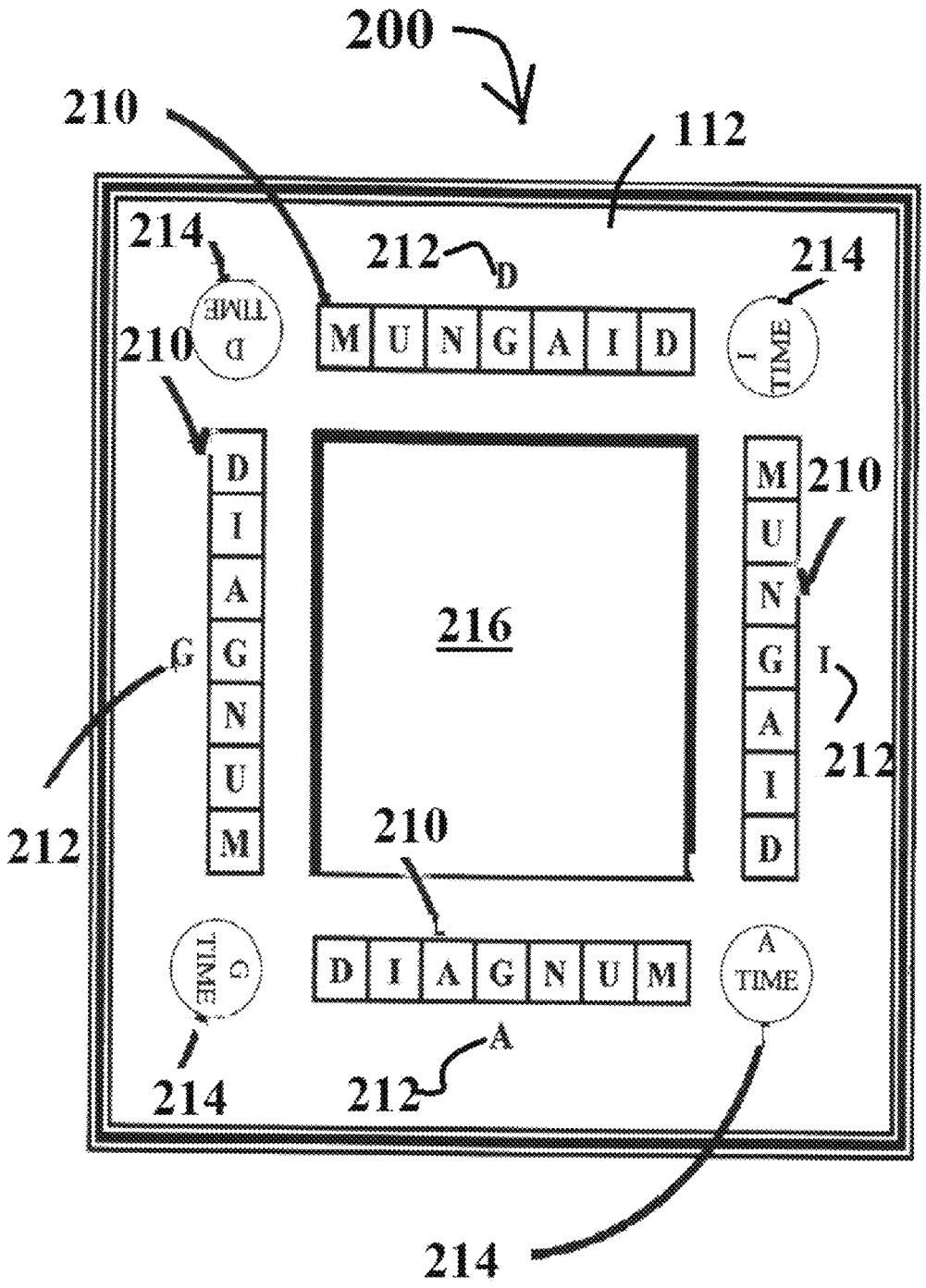
FIG. 2 illustrates a top view of the full assembly of the mechanical-mathematical diagonal number board game, with parts breakdown, shown in FIG. 1*a*.

Referring to now to the drawings and, in particular to FIGS. 1*a*-3*d*, a mechanical-mathematical diagonal number board game assembly, generally designated with the numeral 100, is shown. FIGS. 1*a*-1*c* illustrate the board game assembly 100 fully assembled. A partially assembled board game, generally designated as the numeral 200, is shown in FIG. 2.

As shown in FIG. 1B, the board game assembly 100 can include a mechanical swivel device 110 (shown in phantom in FIG. 1*c*) that is positioned between a game cartridge carrier 114 and an essentially flat play base 112. The game cartridge grid 301 is placed within the game cartridge carrier 114.

The mechanical swivel device 110 is essentially placed at the center of the assembly 100 to provide players with the ability to rotate the game assembly 100 up to 360 degrees. The game cartridge grid 301 is shown in more detail in FIG. 3*a*. The game board 302 is a multicolor game board, as shown in FIG. 3*b*. The game board 302 can be referred to as game board #6 in this exemplary embodiment.

The configuration of the board game assembly 100 is further illustrated in depth in FIG. 1*c*. The game cartridge grid 301 sits within the game cartridge carrier 114, which is attached to the board game play base 112 through a swivel device 110. The game board 302 is inserted into the game cartridge grid 301. The game board 302 is placed within the trap area 116 of the game cartridge grid 301. In the exemplary embodiment, the game cartridge grid 301 has a dimension of 7"×7"×1", and the game cartridge carrier 114 has a height of ½" with a parameter enveloping the game cartridge grid 301.

The game cartridge grid 301 comprises a forty-nine space hallow grid located on top of a base, forming a hollow trap area 116 therebetween. The opening in front of the game cartridge grid 301 allows the game board 302 to be inserted therein. As such, when the game board 302 is withdrawn from the game cartridge grid 301, each game tile may fall below the grid on the game cartridge grid 301 and into the trap area 116.

In the exemplary embodiment, the game cartridge grid 301 sits inside and swivel with the game cartridge carrier 114. The game cartridge carrier 114 sits atop and is permanently attached to the mechanical swivel device 110, which is in turn permanently attached to the top of the game board play base 112. The swivel device is located approximately at center of the game cartridge carrier 114 and the game board play base 112.

Figure 3A:
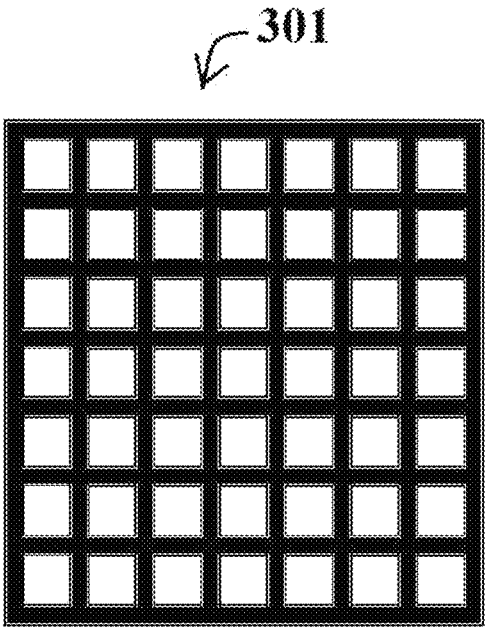
FIGS. 3*a*-3*d* illustrate an overview of the layout and configuration of the game board and the game board insert in specific orientations according to the disclosure.
Figure 3B:
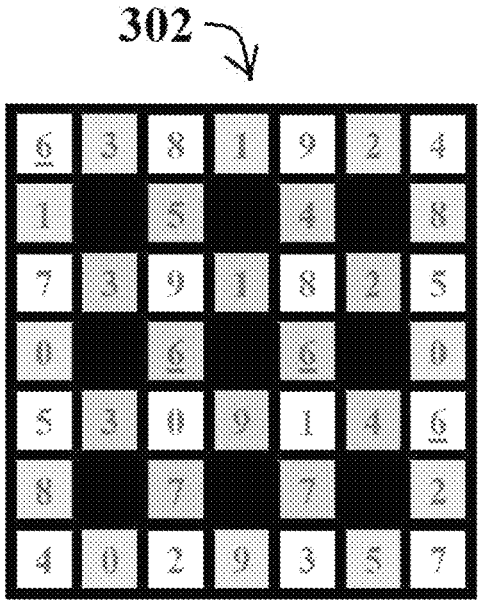
Figure 3C:
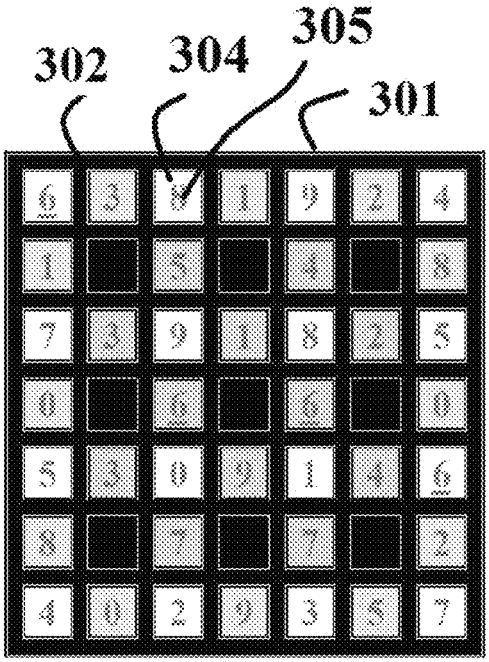
Figure 3D:
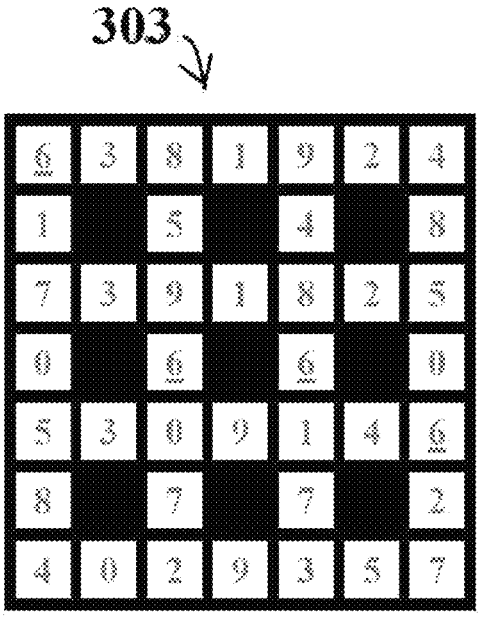

FIG. 3*c* illustrates the multicolor game board 302 inserted into the game cartridge grid 301. FIG. 3*d* illustrates a black and white game board. As shown in FIG. 1, the board game assembly 100 can include the game cartridge grid 301 with the game board 302 inserted therein for play. The board designation will become clear in the subsequent descriptions.

As shown in FIG. 2, the board game assembly 100 can include a board game play base 112, which can be a flat particle-board approximately 12 inches square. The play base 112 functions as a supporting base for the game board assembly 100.

The lower surface 200 includes number piece holding-cells grid 210, one for each player, that are placed around the section aligning with each edge of the board game play base 112. The number piece holding-cells grid 210 include seven 1-inch square spaces arranged on the game board in a rectangular row surrounded by a raised 1/16 square inch wooden or plastic support grid. The number piece holding-cells 210 are designed to temporarily retain a player's game board number pieces (GNPs) as the game is played.

Each of the grids 210 includes a plurality of cell spaces that have one of the letters D, I, A, G, N, U, M. printed thereon. The GNPs in holding are played "out-of-holding" onto the game board in a sequence of last-in-first-out.

After a player withdraws a GNP from the Shaker bag, or when a player's GNP has been returned to them for a "Play-Move" violation", it is placed into the player's number piece holding-cell starting in the far-left D-cell position.

Referring to FIG. 2, each player's designated letter position (DLP) 212 has one of the letters "D", "I", "A", and "G" printed thereon, so that all four letters appear on the four sides of the board. Each of the DLPs 212 provides a scorekeeper with the ability to keep track of the player that makes a Game-Call.

As the players play the board game, they assume the designated letter at that corresponds to their sitting position on the board. The specific letter at their sitting position becomes the player's letter designated identifier to the scorekeeper.

The lower surface 200 includes a plurality of time spot positions 214. Each time spot position 214 is located to the right side of one of the number piece holding-cell grids 210. The time spot position 214 is used to place a thirty-second sand timer during a player's turn.

A receptacle 216 for receiving the game cartridge grid 301 is located between the holding-cell grids 210.

As shown in FIGS. 3*a*-3*c* the game board cartridge grid 301 is designed to support the inserted diagonal number game boards 302 for game play. The game boards 302 can be multicolor or black and white with each game board 302 being assigned a number.

Each game board cartridge grid 301 is a 7-inch square by 1-inch square box frame supporting a 7-inch square, 3-dementional wood or plastic grid. The grid is constructed using. approximately 1/16 square-inches by 1/16 square-inch wood or plastic materials crisscrossed vertically and horizontally forming forty-nine 1-inch squares with hallow spaces.

The game board cartridge grid 301 creates a raised 3-dementional border surrounding the printed gridlines on the diagonal number game board. the spaces within the raised grid are hollowed out to allow the GNPs to fall through into the trap area 116 once the diagonal number game boards 302 are removed. As shown in FIG. 1*c*, the trap area 116 is an open space underneath the game board cartridge grid 301 with a depth deep enough (approximately 1-inch) to catch and collect all the GNPs that falls through.

The printed gridlines on the diagonal number game board 302 once inserted into the game board cartridge grid 301 aligns perfectly with the game board cartridge grid 301's 3-d raised grid. After the game board 302 is inserted into the game board cartridge grid 301 the top surface of the game board 302 blocks the hollow spaces of the game board cartridge grid 301, creating the playing surface with a raised grid border around each space on the game board 302. The raised game board cartridge grid 301 grid keeps the GNPs in place and aids the players in the GNP in/out manipulations.

After the end of each game the game board cartridge grid 301 can be lifted off of the game cartridge carrier 114. The game board 302 is removed and the GNPs falls down through the hallow spaces into the trap area 116. The game board cartridge grid 301 is then tilted to either side and dumped of the GNPs into a shaker bag.

FIG. 3*b* illustrates the game board 302 as an exemplary multicolor, diagonal number game board identified with the number 6. FIG. 3*d* illustrates another exemplary game board 303 that is black and white game board identified with the number 6.

The game boards 302-303 can be displayed simultaneously and can be inserted into the game board cartridge grid 301. There are forty-nine square spaces 304 on each game board with forty spaces that contain indicia 305 in the form of numbers thereon. Four of each number 0-9 are printed in different GSP within the grid and arranged so that no two of the same number is printed in the same rows across, down, or diagonally. Also, the mathematical differences between all adjacent numbers in all rows equals two or greater.

There are forty spaces on each game board that are considered usable and nine spaces that are considered unusable. The $1^{st}$, $3^{rd}$, $5^{th}$ and $7^{th}$ rows and columns consist of all useable spaces. The $2^{nd}$, $4^{th}$, and $6^{th}$ rows and columns are all alternating usable and unusable spaces with the first space being usable. GNPs are not to be played in the unusable spaces. Each usable and unusable space can be identified on the game board by where their GSP #s are located on the game board.

Figure 4:
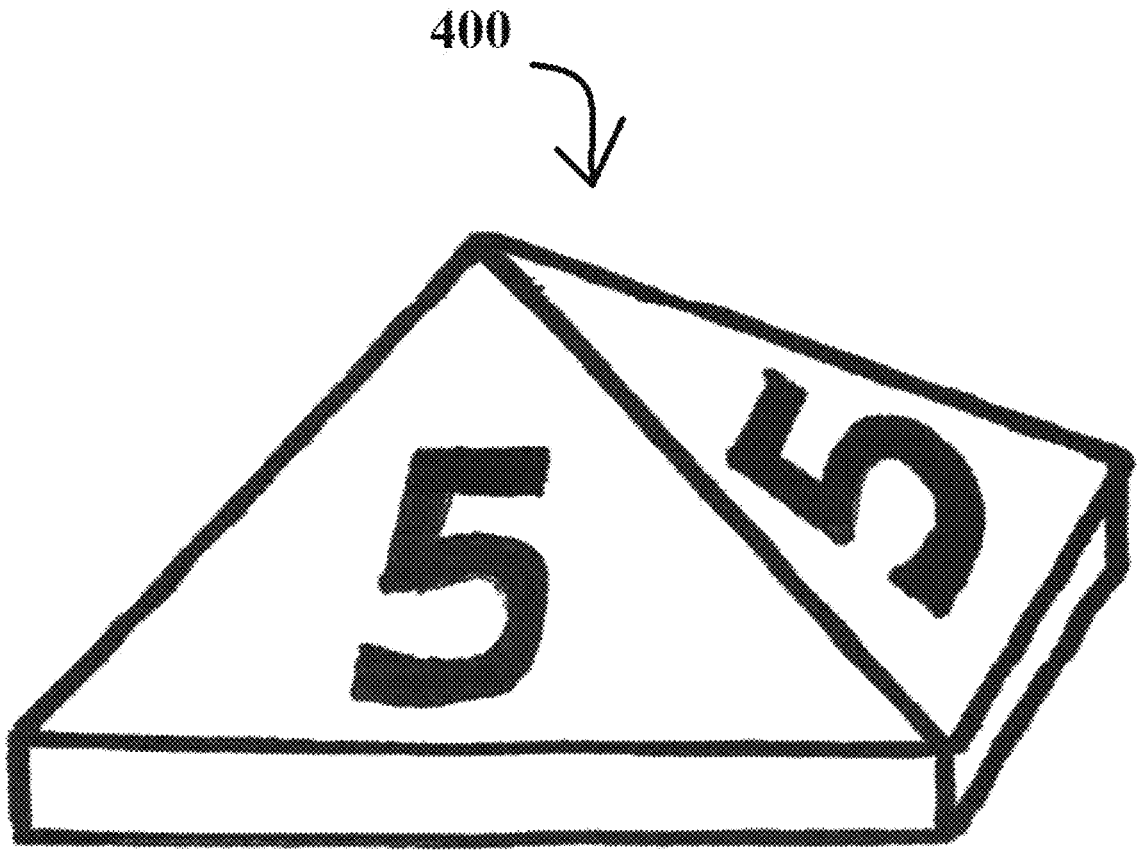
FIG. 4 illustrates a top view of a pyramid number piece (PNP) in accordance with the disclosure.

Referring now to FIGS. 4-8, various components of game that can be used with the game board assembly 100 shown in FIGS. 1*a*-2 are shown. FIG. 4 illustrates the pyramid number piece (PNP) 400. PNPs 400 are stand-alone game number pieces approximately ¾-inchs square ideally designed for the game. There are forty PNPs 400 used in the game. Four of each PNP 400 is printed on all four sides with one number 0-9.

When set atop a matching number on the game board allows a front-face-view of the numbers on the game board simultaneously to all players regardless of their sitting placement around the board game. Flat laying GNPs can be used in the game but the stand-alone PNPs are ideally preferred so to off-set the visual obscurities of the printed numbers, or flat lying tiles on the game board. The pyramid number pieces (PNP), game number pieces (GNP), playing tiles, and tiles are equivalent, functionally, in the exemplary embodiments. For illustrative purposes, the term PNP(s) will now be used instead of GNP in the following description.

Figure 5:
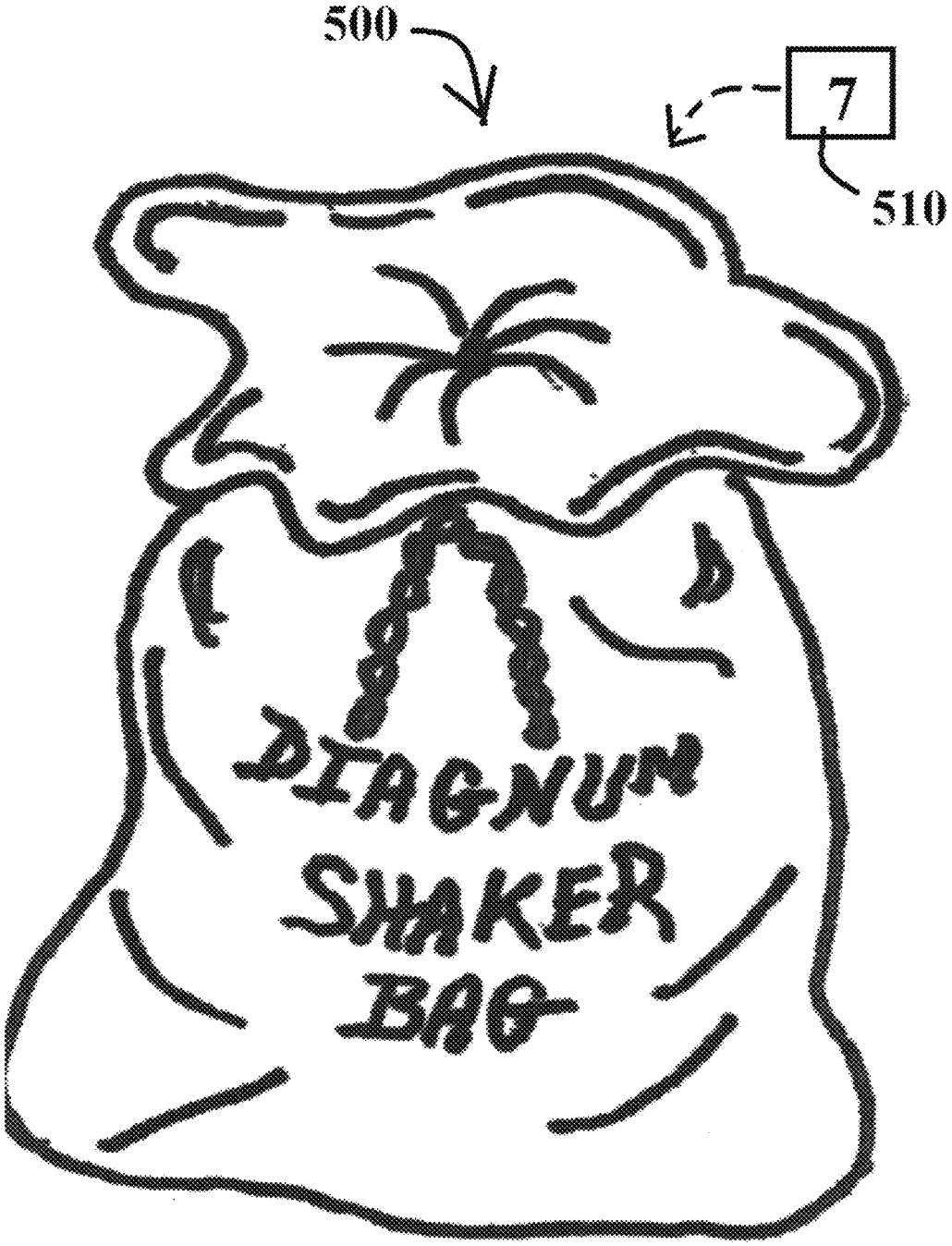
FIG. 5 illustrates a top view of a shaker bag in accordance with the disclosure.

FIG. 5 illustrates the Shaker bag 500. It is a cloth bag with a tie string and is used by the players to withdraw the PNP's out for game play and to store them away at the end of the game. The PNP's can be the PNP 400 as illustrated in FIG. 4. The shaker bag 500 can receive a plurality of game tiles, such as game tile 510.

Figure 6:
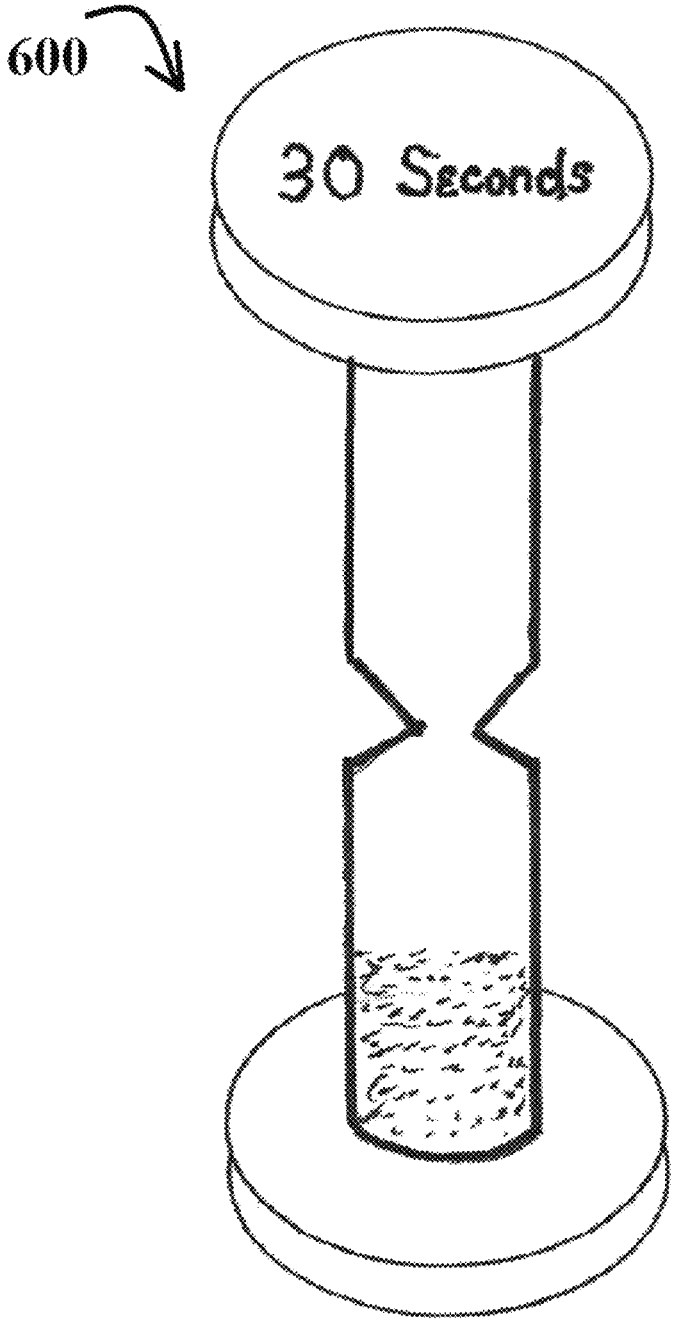
FIG. 6 illustrates a top view of an hourglass thirty-second sand timer in accordance with the disclosure.

FIG. 6 illustrates the 30 second sand timer 600, referred to also as the timer 600. The timer 600 is an hourglass 30 second sand timer that allows all players around the game board to see the actual passing of their playing time more easily. It is placed at each player's "Time Spot Positions" located to the right side of each player's DLP Number Piece Holding-Cell. It is used only after a player withdraws a PNP from the Shaker bag to play. When the timer 600 is turned onto its side the timer 600 is considered paused.

The scorekeeper can be an independent person or a participating player. The scorekeeper must maintain a visual sight on the timer as being the person with the final word on the player's expiration time to continue play. The player's time to continue playing is considered expired when the sand runs out of the timer. If the scorekeeper is an independent person the scorekeeper calls out the next player's time to play in the clockwise direction by calling out for example, "D-Time". The player then passes the timer to Player "D" placing the timer into Player "D" Time-Spot position.

If the scorekeeper is one of the participating players, each player including the scorekeeper calls in their own playing time after the previous player's time has expired. After a player withdraw a PNP from the Shaker bag and placing it in their Holding-Cell the player begins their own start times to play by flipping the timer over. The player then has 30 seconds to make a "Game-Call.".

When the time expires for the current player the next player-in-turn calls their time to play. For example, if Player "I" is the current player and their time had expired, Player "A" would call out "A-Time". If a dispute occurs between players, the scorekeeper can pause the timer by placing the timer onto its side until the dispute has been settled.

Figure 7:
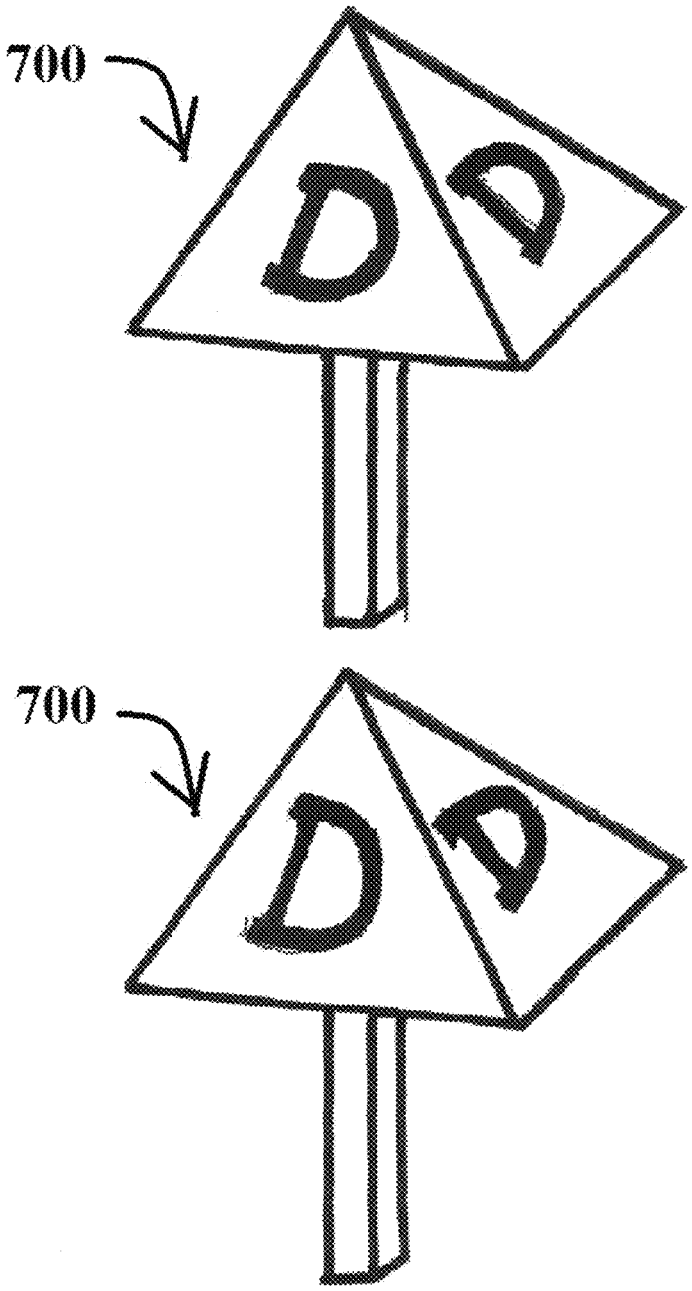
FIG. 7 illustrates a top view of scoreboard twin scoring pins in accordance with the disclosure.

FIG. 7 illustrates the "Scoreboard Twin Scoring Pins", generally designated by the numeral 700. The pins 700 are used to mark each player's game points on the Quad-Play DIAGNUM Scoreboard. The scorekeeper controls the players Twin Scoring-Pins. Two of each Twin Scoring-Pins 700 are printed on all four sides with one of each letter D, I, A, G associated with each player's DLP's. One Twin Scoring-Pin is used to mark the one's columns 0-9 and the $2^{nd}$ Twin Scoring-Pin is used to mark the ten's columns 10-90.

The scorekeeper places each player's Twin Scoring-Pins 700 at the "0" Start line on the Quad-Play DIAGNUM Scoreboard at the beginning of the game. The scorekeeper advances each player's scores from 0-99 points by marking their scores with their associated DLP Twin Scoring Pins 700.

FIG. 8 illustrates the Quad-Play DIAGNUM Scoreboard 800, a tabletop multiplayer gaming scoreboard designed to track the game scores for up to four players at once, eliminating the need for pencil and paper. The scoreboard 800 is printed on the top, center, and bottom rows with the letters D-I-A-G, associated with each sitting player's DLP's around the game board 800. The left and right margins on the scoreboard 800 are the point columns numerated with two separate rows of numbers representing the ones columns 0-9 and the ten's columns 10-90. The columns are separated in the middle row of the scoreboard by the "0" START row that represents the starting point where all player's Twin Soring Pins are placed at the beginning of each game. The Quad-Play DIAGNUM Scoreboard is controlled by the scorekeeper. As each player scores points the scorekeeper advances each player scores on the Quad-Play DIAGNUM Scoreboard under their associated DLPs.

Referring now to FIG. 9*a*-9*t*, an exemplary set of two-sided game boards are illustrated. Each game board within the set is identified by the first number 0-9 printed in the top far left corner of the row. The printed number pattern is arranged differently on each game board to offer the players with different playing experiences.

The Diagonal Number Game board grids are designed having the same seven 1-inch square gridline dimensions as the Game board Cartridge grid except the gridlines on the game boards are printed. The spaces within the grid are colored in using a "Multicolor" pattern on one side and a "Black and White" pattern on the reverse. The numbers that are printed within the spaces on the game board are printed in the same "Grid Space Positions" (GSPs) on both sides.

FIG. 9*a* illustrates a black and white game board designated as the #0 black and white game board. FIG. 9*b* illustrates a multicolor game board designated as the #0 multicolor game board. FIG. 9*c* illustrates a black and white game board designated as the #1 black and white game board. FIG. 9*d* illustrates a multicolor game board designated as the #1 multicolor game board.

FIG. 9*e* illustrates a black and white game board designated as the #2 black and white game board. FIG. 9*f* illustrates a multicolor game board designated as the #2 multicolor game board. FIG. 9*g* illustrates a black and white game board designated as the #3 black and white game board. FIG. 9*h* illustrates a multicolor game board designated as the #3 multicolor game board.

FIG. 9*i* illustrates a black and white game board designated as the #4 black and white game board. FIG. 9*j* illustrates a multicolor game board designated as the #4 multicolor game board. FIG. 9*k* illustrates a black and white game board designated as the #5 black and white game board. FIG. 9*l* illustrates a multicolor game board designated as the #5 multicolor game board.

FIG. 9*m* illustrates a black and white game board designated as the #6 black and white game board. FIG. 9*n* illustrates a multicolor game board designated as the #6 multicolor game board. FIG. 90 illustrates a black and white game board designated as the #7 black and white game board. FIG. 9*p* illustrates a multicolor game board designated as the #7 multicolor game board.

FIG. 9*q* illustrates a black and white game board designated as the #8 black and white game board. FIG. 9*r* illustrates a multicolor game board designated as the #8 multicolor game board. FIG. 9*s* illustrates a black and white game board designated as the #9 black and white game board. FIG. 9*t* illustrates a multicolor game board designated as the #9 multicolor game board.

Figure 10:
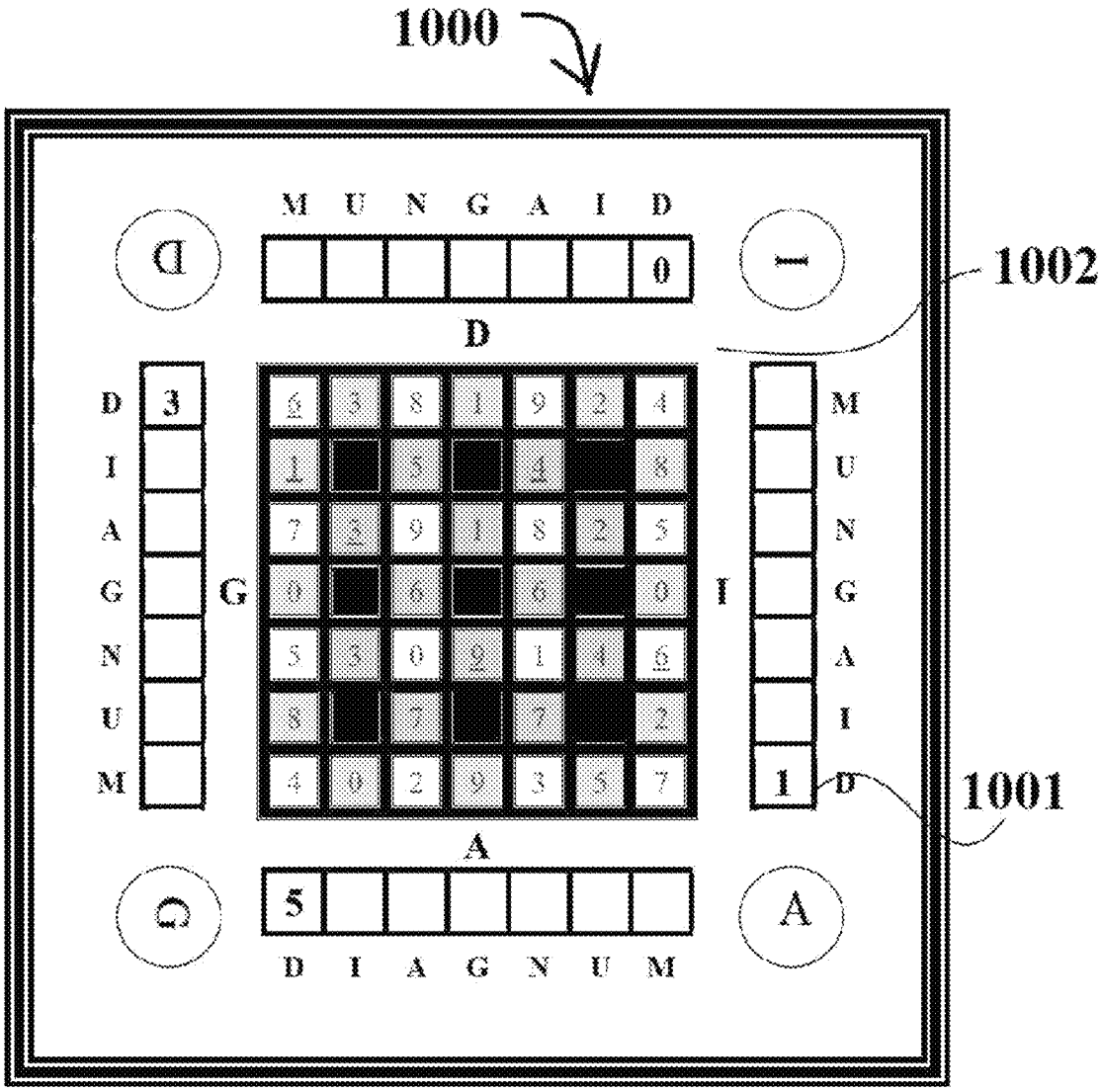
FIG. 10 is a schematic diagram of each player's first withdrawn PNP placed in their respective number piece holding-cells in accordance with the disclosure.
Figure 11C:
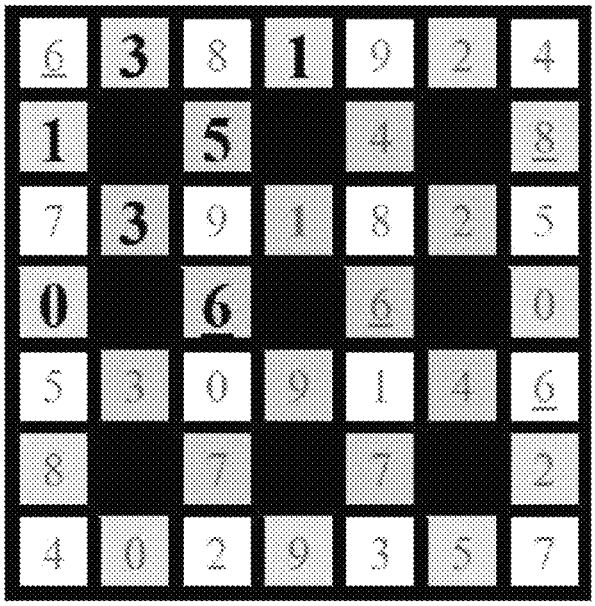
FIG. 11*c* illustrates a game player's second pyramid number piece placements on the game board to score game points in accordance with the disclosure.
Figure 11D:
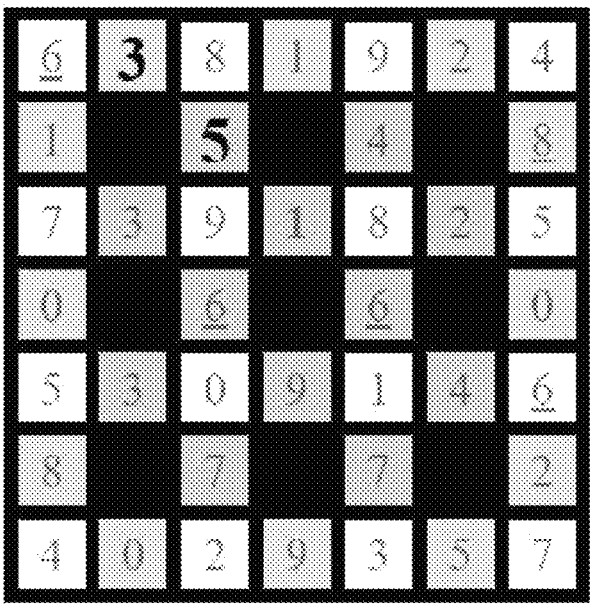
FIG. 11*d*-11*f* illustrates a standard (DIAG) and alterative (DIAGNUM) Point Scoring Calls in accordance with the disclosure.
Figure 11E:
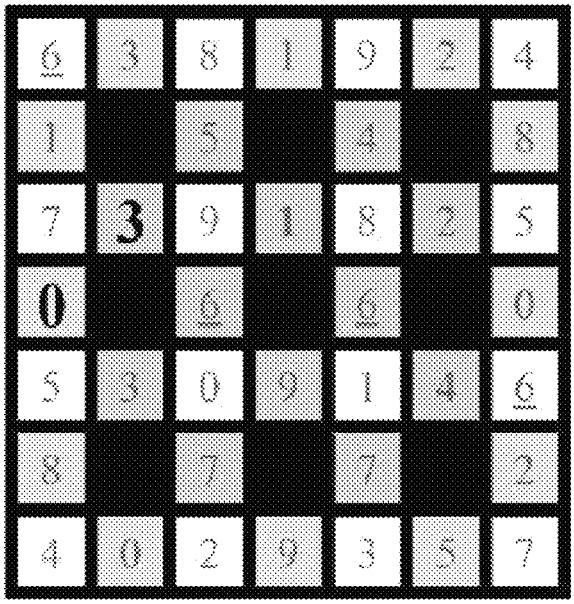
Figure 11F:
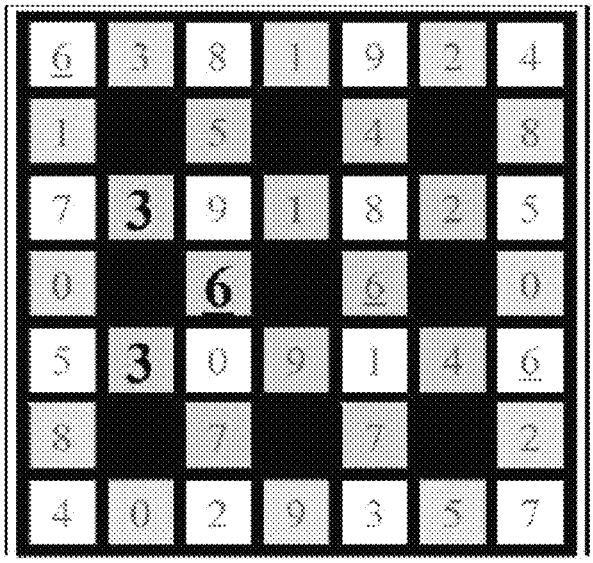

Referring now to FIGS. 10-11*f*, an embodiment of a game board, generally designated by the numeral 1000, is shown. In this exemplary embodiment, the placement of each player's first withdrawn PNP's placed into their perspective Number Piece Holding-Cells after the draw for first play onto the game board 1000. A pyramid number piece (PNP) 1001 is placed on the first location of each player's holding cell, in this exemplary embodiment designated with the letter "D". The players will attempt to place PNP 1001 onto the respective cells on the game board 1001. A sequence of play and game call is further explained below.

As shown in FIG. 11*a*, numbers referencing the "Grid Space Positions" (GSPs) are printed in bold italic. Numbers referencing "Pyramid Number Pieces" (PNPs) are printed in straight print. FIG. 11*a* illustrates the numeration of the Diagonal Number Game board forty-nine GSPs within the game board grid.

The first space within the grid is located in the top far left row and is referred to as Grid Space Position #1 (GSP #1). The last space in the top far right row is considered GSP #7. The second row contains GSP #'s 8-14. The third row contains #'s 15-21, $4^{th}$ row #'s 22-28, $5^{th}$ row #'s 29-35, $6^{th}$ row #'s 36-42, $7^{th}$ row #'s 43-49. Depending on which GSP the numbers are printed in determines if the PNP played atop that GSP would be worth any game points to the players.

In various embodiments, the diagonal number game boards are designed with varying color patterns to further provide variety in gameplay and difficulty. The Multicolor side of the Diagonal Number Game boards offers the players with a visual advantage in deciding what GSPs provides a greater chance for scoring game points. The Black and White side of the Diagonal Number Game board erases this visual advantage.

There are four colors used in each game board. The first color is black in an exemplary embodiment. Black spaces identify the unusable spaces on each game board. Unusable spaces are located in the same GSPs on both sides of all ten game boards. The nine unusable GSPs are #9, 11, 13, 23, 25, 27, 37, 39 and 41.

The $2^{nd}$ color is white in an exemplary embodiment. White spaces are considered usable. There are forty white spaces on the black and white side of each game board and sixteen white spaces on the multicolor side. The white GSPs #1, 3, 5, 7, 15, 17, 19, 21, 29, 31, 33, 35, 43, 45, 47 and 49 on both sides of the game board are considered "Dead Number Spaces".

PNPs played into these GSPs only rids the number pieces for play and do not offer the player any scoring points. Players must become keen as to which WHITE GSPs offers scoring points and which ones are Dead Number Spaces.

The $3^{rd}$ color is tan in an exemplary embodiment. Tan color spaces make possible for a double-diagonal connection between adjacent GNPs in the diagonal rows. There are twelve tan GSP #'s 2, 4, 6, 8, 14, 22, 28, 36, 42, 44, 46, 48. The same GSP #s on the black and white side of the game board offers the same diagonal connection points.

The $4^{th}$ color is blue in an exemplary embodiment. Blue color spaces make possible for a diagonal connection between up to four adjacent diagonal spaces using two diagonal rows at the same time. There are twelve blue GSP #'s 10, 12, 16, 18, 20, 24, 26, 30, 32, 34, 38, 40. The same GSP #s on the black and white side of the game board offers the same diagonal connection points.

When viewing the printed numbers on the game board from a front-face-view, the numbers face in one direction. As the direction of the game board changes during the swiveling of the Mechanical Swivel Device 110, shown in FIGS. 1*a*-1*b*, the numbers facing the player can appear visually obscured. For example: When facing the number "9" in a front-face-view on the game board, it would appear up-side-down as the number "6" to the player on the opposite side of the game board, or the #2 can appear as the #5. Players with side-face-views can also find some difficulty in visualizing the correct printed numbers.

Normally, printed alphanumeric game board pieces are created as flat laying game tiles that can, at times, present the same visual obscurities on the game board as described above. Ideally, numbering on the game board should allow for a front-face-view of the numbers simultaneously to all players regardless of their sitting orientation around the game board. Using a matching PNP placed atop the printed number on the game board would offset this visual obscurity for the players.

The disclosed game uses a set of rules: (1) Using single digit subtraction between adjacent diagonal connecting number pieces in all diagonal rows, and (2) Adding their combined differences together to score game points to win. The first player who reaches the DIAGNUM score of 99 game points win the game. Player's game scores that go backwards less than "0" points are eliminated.

There are five Game-Calls possible to be made by each player during their Turn-In-Play. (1) PASS up their turn: (2) Make a PLAY-Move to rid the PNP: (3) Make a CATCH-Call for a Play-Move or Scoring-Call Violation: (4) Make a DIAG or DIAGNUM Scoring-Call for game points: (5) RECOVER a PNP Play-Move Violation.

Players must be exact when calling out their perceived scoring points. Players must first calculate their score then use their DLP in front of any Game-Calls made. Incorrect Game-Calls made by the players are subjected to a "Catch-Call" violation and can result in the loss of game points for the "Caught-Player", or to reward game points to the "Catch-Player".

The Game-Call "PASS" is used by the players when they want to pass up their turn for a possible opportunity in scoring greater game points at their next Turn-In-Play. After a player withdraws a PNP from the Shaker bag and places it into their Number Piece Holding-Cell the scorekeeper starts the timer and the player's time to make a Game-Call starts. The player can use their 30 second time period to decide what Game-Call option they can want to use.

Players must call out their DLP first before making any Game-Calls. If a player decides to pass up their turn they make the Game-Call for example, "D-PASS turn", or just "D-PASS". The scorekeeper will know Player "D" made the Game-Call "PASS" and who is next in turn. When a player calls "PASS" their playing time expires immediately regardless of how much time is left on the timer. The turn then moves to the next player in the clockwise direction.

The Game-Call "PLAY" is called when a player wants to get rid of a PNP from out their Number Piece Holding-Cell or to play a withdrawn PNP from the Shaker bag onto the game board. If for example, Player "I" is making a Play-Move with the #5 PNP Out-of-Holding, the timer is not used. Player "I" can take a reasonable amount of time (10 seconds) to make a Game-Call. Player "I" can place the #5 PNP atop any one of the four printed #5's on the game board.

After a decision is made and Player "I" places their #5 PNP atop their selection, Player "I" makes the Game-Call "I-PLAY-5. When a player makes a Play-Move Out-of-Holding their playing-time expires immediately. The scorekeeper will know Player "I" called a "Play-Move" and who is next in turn. The turn then moves to the next player in the clockwise direction.

When a player withdraws a PNP from the Shaker-Bag and places it into their Number Piece Holding-Cell the timer is used and the scorekeeper starts the player's time to make a Game-Call. The player can use their 30 second time period to decide what Game-Call option they want to use.

Rather a player makes a PNP Play-Move Out-of-Holding or from a withdrawn PNP from the Shaker bag, no scoring points are possible to be made. The loss of game points is possible if the Play-Move is called incorrectly.

The Game-Call "CATCH" is called by the current player "Catch-Player" when they want to call out the previous player "Caught-Player" Play-Move or Scoring-Call Violations. Catch-Calls are made by the Catch-Player immediately after the Caught-Player makes a Play-Move or Scoring-Call Out-of-Holding, or after a Play-Move or Scoring-Call is made from a withdrawn PNP played out of the Shaker bag once the current players playing time had expired.

Catch-Calls cannot be made by the Catch-Player on a Caught-Player if they make a Game-Call first, make a Play-Move Out of Holding, or withdraw a PNP from the Shaker bag. If a Catch-Call is made the scorekeeper will determine the validity of the catch and reward each player with their perspective scoring points. If a Catch-Call is made at the same time by multiple players, the player closest to the Caught-Player in the clockwise direction has priority in making the Catch-Call and receiving additional scoring points. The Catch-Player do not lose their turn if next in play.

There are four each number 0-9 printed and arranged in four different spaces on each game board. No two game boards are alike. The printed numbers could exist in dead number spaces or in multiple multicolor diagonal scoring spaces. Placing PNPs atop the unusable (Black) spaces or numbers other than itself are subject to "Play-Move Violations".

For example, if player "A" places the #9 PNP atop the #6 PNP and calls "A-PLAY-9", Player "G" could make a Catch-Call on Player "A" for making a Play-Move Violation. Player "G" would call "G-CATCH-A-PLAY-9". Player "G" is the "Catch-Player" and Player "A" is the "Caught-Player". In this instance the #9 PNP is returned to the Caught-Player "A" and placed in their Holding-Cell and 9 game points are subtracted from their game score. The Catch-Player "G" would be rewarded the same 9 game points.

If the #0 PNP is played atop any other number than itself or on an unusable black space and caught by another player, the Caught-Player is subtracted 10 game points and the Catch-Player is rewarded 10 game points. The #0 PNP is returned to the Shaker bag.

Players cannot make DIAG or DIAGNUM Scoring Calls with adjacent connecting PNPs in the dead-number spaces. Scoring-Calls made using these spaces would be considered Play-Move Violations if caught. Also, if a player makes an adjacent diagonal connection and call "PLAY" instead of making a DIAG or DIAGNUM Scoring-Call, the Play-Move will stand once time had expired. Players can change their Game-Calls at any time before their 30 second time period expires. The last Game-Call made by a player stand once their 30 second time period expires.

The Game-Calls "DIAG or DIAGNUM" are used when a player wants to score game points. To make a score players must first place their PNP onto the game board adjacent to another PNP sitting in the diagonal row. The player must first calculate their perceived scoring points by using subtraction between all diagonal connecting PNPs and then use their DLP in front of their perceive scores before making any Game-Calls. When multiple diagonal connections are made the combined differences between diagonal connecting PNPs are added first before making a Game-Call.

As shown in FIG. 11*d*, if player "G" played the #5 PNP diagonally adjacent to the #3 PNP, Player "G" would make the Scoring-Call, "G-DIAG-2", the mathematical difference between the numbers (5 and 3=2). Player "G" would receive 2 Scoring Points. The Scoring-Call would be the same if Player "G" played the #3 PNP diagonally adjacent to the #5 PNP.

As shown in FIG. 11*e*, when the #0 PNP is Played Diagonally Adjacent to any other #PNP the player receives the scoring point difference between the #0 PNP played and the #PNP played against. For example, if Player "G" played the #0 PNP diagonally adjacent to the #3 PNP, Player "G" would make the Scoring-Call "G-DIAG-3" and receive 3 scoring points. When any #PNP is played diagonally adjacent to the #0 PNP the player has a DIAG or DIAGNUM scoring choice.

It is possible for the players to make 1-4 diagonal row connections at the same time to score game points. Players must place their PNP onto the game board making connections with other adjacent connecting PNPs in the diagonal rows. The player first subtracts each of their differences separately then add their combined differences together that gives the total scoring points for the player to call.

Alternatively, DIGANUM scoring can be utilized. During most turns, the number printed on the PNP played onto the game board will not equal the same number of scoring points made as previously illustrated. However, in certain turns, the player's scoring points equal the number printed on the PNP played. When this happens, players are rewarded double scoring points for the #PNP played.

As shown in FIG. 11*f*, if Player "D" played the #6 PNP adjacent to two #3 PNPs in different diagonal rows, the added differences between all diagonal connecting PNP's would equal 6, the same number as the #6 PNP played. Player "D" has a choice as to which Scoring-Call to make.

Player "D" can make the Scoring-Call, "D-DIAG-6", and receive 6 scoring points. Player "D" could also make the Scoring-Call "D-DIAGNUM-12 and receive 12 points (double the #6 PNP played). By making the Game-Call DIAGNUM instead of DIAG earns the player double scoring points. Both Game Scoring-Calls are valid. If Player "D" calls "D-Diag-3" it would be an Under-Call scoring violation.

If a player makes a diagonal connection to score points and call "Play" instead of DIAG or DIAGNUM, the "Play-Move" made will stand. No points would be scored once the time period to change the call had expired.

Players should not over/under call their perceived scoring points. Overcalling scoring points by players is a violation subjected to have their game scores decreased if caught. Under calling points enables other players scores to increase.

For example, if Player "D" makes the Scoring-Call "D-DIAG-3" and the possible points was 6, the next player in turn can call out Player "D" Under-Call scoring point violation after the time had expired before Player "D" corrects the Scoring-Call.

The Catch-Call would be "I-CATCH-D-DIAG-3". The Caught-Player "D" would be rewarded 3 scoring points out of the 6 possible points and the Catch-Player "I" would receive the extra 3 under called points.

If Player "D" overcall scoring points for example, "D-DIAG-14" and the possible points to be made was only 4, the overcalled difference is 10 scoring points. If caught by Player "I", Player "I" would not receive any scoring points however, 10 game points would be subtracted from Player "D" game score. If Player "D" game score goes backwards less than "0" points Player "D" would be eliminated from the game.

For example, if Player "D" game score is currently 5 points and makes the Scoring-Call "D-DIAG 14" and the possible points to be scored was 4, 10 overcalled scoring points would be subtracted from Player "D" 5 game point score and Player "D" score would go backwards less than 0 and be eliminated from the game.

"Recover-Calls" are used at times when a PNP is discovered sitting on the game board atop a different number than itself after a full round of play, or found sitting in a black (unusable) space and considered a Play-Move Violation. Recovery calls can be made by any player in turn only after a complete Play-Round to them have been made.

The Game-Call for recovering a misplaced PNP is for example, "I-RECOVER-PLAY-3". The #3 PNP is recovered off the game board and returned to the Shaker bag. The Recovery-Player "I" is rewarded 3 scoring points, the number printed on the PNP. When the #0 PNP is recovered the Recovery-Player receives 10 scoring points.

It would be considered a Play-Move Violation when any two of the same number PNPs are found on the game board in the same row in any direction. With each game board the mathematical differences between all adjacent numbers in all rows equals two or greater without repeating any number in the rows. By comparing the printed number on the game board against the PNP number played atop, players can easily identify which PNP played is incorrect.

In reference with the preceding overview of the game rules, a description of play is provided herein to illustrate typical play sequences. This description of play will illustrate and demonstrate a fictitious game playing round with the Diagonal Number Board game using four players. It is assumed the four players are, Players "D, I, A. and G" assembled around the Diagonal Number Board game, and the scorekeeper is an independent participant. It is further assumed the multicolor-side of the #6 game board was selected for play and all forty PNPs are accounted for and placed into the Shaker bag. The 30 second sand timer sits at rest with the scorekeeper and all player's Twin Scoring Pins are positioned at the "0" START line on the Quad-Person DIAGNUM Scoreboard.

The game is initialized by each player D, I, A, and G withdrawing a single game board PNP from the Shaker bag and placing it into each own DLP Holding-Cell, far left #1 D-Number-Cell position. This is to see which player withdraws the lowest PNP for the chance to play first onto the Diagonal Number Game board.

If a tie occurs, the tie players retain their withdrawn PNP in their perspective Holding-Cell and withdraws a new PNP from the Shaker-Bag. The selection of new PNPs continues until one player has the lowest PNP number. The draw goes as follows. Player "D" withdraws the #0 PNP; Player "I" withdraws the #1 PNP; Player "A" withdraws the #5 PNP; and Player "G" withdraws the #3 PNP. Player "D" winning the draw for first play onto the game board must consider where on the game board to play their #0 PNP. The #0 is printed in four different spaces throughout the game board, GSP #'s 22, 28, 31, and 44.

Player "D" has three Game-Call options to either: (1) PASS up their turn: (2) Make a Play-Move Out-of-Holding to rid the PNP: (3) Withdraw a new PNP from the Shaker bag. The timer is not used until a player withdraws a PNP from the Shaker bag and places it into their Number Piece Holding-Cells. Players can take a reasonable amount of time (10 seconds) to make a Game-Call.

Player "D" decides to pass up their turn by making the Game-Call, "D-PASS". Player "D" #0 PNP is retained in their Number Piece Holding-Cell until their next turn in play. Because the timer is not used when playing Out-of-Holding the players Game-Call stands and cannot be changed. The scorekeeper then calls, "I-Time" and the turn moves to Player "I".

Player "I" has the #1 PNP retained in their Number Piece Holding-Cell with having the same three Game-Call options as Player "D". Player "I" can take a reasonable amount of time (10 seconds) to evaluate the previous player's Game-Call before making a Game-Call or withdrawing a PNP from the Shaker bag.

As shown in FIG. 11*a*, the numeration of the Diagonal Number Game board forty-nine Grid Space Position numbers (GSP #s). As shown in FIG. 11*b*, Player "I" can recognize the #1 is located in one white "dead-number-space" GSP #33, one blue "quad-connection space" GSP #18, and two tan "double-connecting spaces" GSP #4 and #8. Player "I" then decides to play Out-of-Holding rather than passing their turn or withdrawing another PNP and places their #1 PNP atop the tan space GSP #8 and make the Play-Move, "I-PLAY-1". The scorekeeper calls "A-Time", and the turn moves to Player "A".

Player "A" has the #5 PNP retained in their Number Piece Holding-Cell with having the same three playing options as previously described above plus the option to make a Catch-Call on Player "I". Player "A" can take a reasonable amount of time (10 seconds) to evaluate Player "I" Play-Move.

In recognizing the #5 is located at two white spaces GSP #21 and #29, and one blue space GSP #10, and one tan space GSP #48, and no Catch Call is possible, Player "A" decides to play Out-of-Holding rather than passing their turn or withdrawing another PNP. Player "A" places their #5 PNP atop the blue space GSP #10 and makes the Game-Call, A-PLAY-5. The scorekeeper calls, "G-Time. The turn now moves to the next Player "G.

Player "G" has the #3 PNPs in their Number Piece Holding-Cell and sees the #3 on the game board is located in the tan space GSP #2 two blue spaces GSP #16 and #30, and one white space GSP #47. Player "G" places their #3 PNP atop the tan space GSP #2 and makes a diagonal connection with the #1 PNP at GSP #8 and the #5 PNP at GSP #10.

Player "G" then makes the Scoring-Call, "G-DIAG-4", the mathematical differences between all diagonal connecting PNPs added together (3-1)+(5-3)=4. If no Catch-Call was made the scorekeeper advances Player "G" 4 scoring points then calls "D-Time". The turn moves back to Player "D".

As shown in FIG. 11*c*, Player "D" still has the #0 PNP retained in their Number Piece Holding-Cell from their previous turn. Having four of five playing options available and no PNPs to recover, Player "D" decides to play Out-of-Holding and places their #0 PNP atop the #0 at the tan spaces GSP #22 and make the Game-Call, "D-PLAY-0" The scorekeeper calls the next player in turn, "I-Time". The turn then moves to Player "I".

Player "I" not having any PNPs currently in their Number Piece Holding-Cell must withdraw a PNP from the Shaker bag, or make a Catch-Call on Player "D" Play-Move, or pass up their turn. Player "I" withdraws the #3 PNP and places it into their Number Piece Holding-Cell and the scorekeeper starts the timer. Player "I" must make a Game-Call within the 30 second time period or the #3 PNP is retained in their Number Piece Holding-Cell.

Player "I" finds the #3 at the white space GSP #47 and two blue spaces GSP #16 and #30. Player "I" decides to place their #3 PNP atop the #3 in the blue space GSP #16 and make the Scoring-Call I-DIAG-7, the combined differences added together between all three diagonally connected PNPs, (3−1)+(5−3)+(3−0)=7. The scorekeeper waits until the timer expires before calling in the next player in turn. This allows the current Player "I" time to change their Scoring-Call and the other players time to examine the Scoring-Call made to make a Catch-Call for a Scoring-Call or Play-Move violation.

Player "I" can change their Scoring-Call as long as the 30 second sand timer is running. When the 30 second sand timer runs out of sand the player's time expires and the scorekeeper calls in the next player in turn. If no Catch-Call is made the scorekeeper advances Player "I" game score 7 scoring points and calls "A-Time". The turn moves to Player "A".

Player "A" not having any PNPs currently in their Number Piece Holding-Cell must withdraw a PNP from the Shaker bag, or make a Catch-Call on Player "I" Scoring-Call, or pass up their turn. Player "A" withdraws the #1 PNP and places it into their Number Piece Holding-Cell and the scorekeeper starts the timer.

Player "A" must make a Game-Call within the 30 second time period or the PNP is retained in their Number Piece Holding-Cell. Player "A" places their #1 PNP atop the #1 tan space GSP #4 and makes a diagonal connection with the #5 PNP at GSP #10. Player "A" makes the Scoring-Call, "A-DIAG-4". After the time has expired for Player "A" and no Catch-Calls were made, the scorekeeper advances Player "A" game score 4 scoring points and calls, "G-Time".

Player "G" not having any PNPs currently in their Number Piece Holding-Cell must withdraw a PNP from the Shaker bag, make a Catch-Call on Player "A" Scoring-Call, or pass their turn. Player "G" withdraws the #6 PNP and places it into their Number Piece Holding-Cell and the scorekeeper starts the timer.

Player "G" places their #6 PNP atop the #6 blue space at GSP #24 and makes a diagonal connection with the #3 PNP at the blue space GSP #16. Player "G" makes the Scoring-Call "G-DIAG-3" and receives 3 scoring points. The turn loops back around to Player "D".

Player's Turn-In-Play continues to move in the clockwise direction around the board game. When the last of all forty PNPs are withdrawn from the Shaker bag and played onto the game board, the "Game-Round" ends regardless how many PNPs are retained in each player's Number Piece Holding-Cell. The next Player-In-Turn cannot make any Play-Moves or Scoring-Calls.

At the end of each Game-Round the scorekeeper decides if a player has reached the 99 game points to win the game. If no player has reached 99 game points, the sum total of all remaining PNPs left in each player's Holding-Cell is subtracted from each player's total game scores and the PNPs are returned to the Shaker bag. The "#0" PNP has no point value when counting.

A new Game-Round must be started and repeated until a winner has been determined. Each new Game-Round starts with the draw for first play onto the game board. After a player is declared the winner of the game, the Diagonal Number Game board is removed from the Game board Cartridge and dumped of the PNPs into the Shaker bag for storage.

Supported Features and Embodiments

The detailed description provided above in connection with the appended drawings explicitly describes and supports various features of a mechanical-mathematical diagonal number board game with 2-sided interchangeable game boards. By way of illustration and not limitation, supported embodiments include a system for a mechanical-mathematical diagonal number board game comprising: a game timer; a game board cartridge; a plurality of game boards for inserting into the game board cartridge; a play base having a plurality of grids and plurality of timer spots for receiving the game timer with each grid having a plurality of holding cells for receiving one of the plurality of numbered game tiles; a game board cartridge carrier for removeably holding the game board cartridge with the game board cartridge receiving at least one of the plurality of game boards; and a plurality of numbered game tiles with each of the plurality of tiles having playing tile indicia corresponding to an integer selected within the range of 0 to 9; wherein the game board cartridge is positioned over the play base and can be rotated in relation thereto; wherein each of the plurality of game boards is marked with a game board grid having a plurality of rows and columns forming a plurality of squares, with each of the plurality of squares having a game board indicia corresponding to an integer selected within the range of 0 to 9, and with none of the integers repeating within the same row, same column, or with respect to a connecting diagonal square; and wherein the plurality of tiles are drawn during game play, so that a player can make a diagonal connection to score points by matching the playing tile indicia with the game board indicia during a predetermined time period measured by the game timer.

Supported embodiments include the foregoing system, further comprising: a shaker bag for storing the plurality of playing tiles.

Supported embodiments include any of the foregoing systems, further comprising: a score board; and a pair of score pins consisting of a first score pin and a second score pin; wherein the first score pin is configured to track a score of 0-9, and the second score pin is configured to track a score of 10-90.

Supported embodiments include any of the foregoing systems, wherein the plurality of game boards includes ten game boards.

Supported embodiments include any of the foregoing systems, wherein each of the plurality of game tiles is a pyramid-shaped game piece.

Supported embodiments include any of the foregoing systems, wherein the game board grid includes an arrangement of squares formed in seven rows and seven columns.

Supported embodiments include any of the foregoing systems, wherein the game board grid include a plurality of unused squares.

Supported embodiments include any of the foregoing systems, wherein the plurality of game boards includes multicolor game boards, black and white game boards, or both types of game boards.

Supported embodiments include any of the foregoing systems, wherein the game timer in hourglass-shaped container having a sufficient amount of sand contained therein for a predetermined period of thirty seconds.

Supported embodiments include any of the foregoing systems, wherein the game board cartridge includes a cartridge grid and the game board cartridge carrier is configured to allow the plurality of game tiles to fall through the cartridge grid.

Supported embodiments include a method of playing a mechanical-mathematical diagonal number board game, comprising: orienting one of four players on a side of a square shaped board game base; prompting each of the four players to draw one of at least 40 game tiles from a shaker bag with each of the game tiles having a number selected from a group of numbers from 0 to 9 on a game board and being configured to insert into a game board cartridge mounted on a mechanical swivel device located at center of the square shaped board game base; and making at least one game action selected from a group consisting of a play-move action, a score-call action, a catching-call action, and a passing action; wherein the game board is marked with a 7 square by 7 square grid, wherein each of the 7 square by 7 square grid aligns with the game board cartridge grid and is marked with a number selected from a group of numbers from 0 to 9, wherein the number does not repeat in another grid on a same row, column, or diagonal on the 7 square by 7 square grid; wherein the play-move action includes placing one of the at least 40 game tiles on the game board; wherein the score-call action includes announcing a score point with the score point including a sum of differences of numbers between at least two of the game tiles connected diagonally on the game board cartridge; wherein the catch-call action includes identifying any differences between the score point and the sum of differences of numbers between at least two of the game tiles connected diagonally on the game board cartridge, made by another player during a previous score-call actions, and accumulating the differences on the score point; wherein the passing action includes taking no action; and wherein the score points of each of the four players is compared after all of the at least 40 game tiles are withdrawn from the shaker bag.

Supported embodiments include the foregoing method, wherein one of the game actions include a play-call action in which a player conducts play-move and score-call in a same round, wherein a pyramid number piece placed results in a score point.

Supported embodiments include any of the foregoing methods, wherein one of the game actions includes keeping track of the score points on a score board and at least a first score pin and a second score pin, wherein the first score pin is configured to track a score of 0-9, and the second score pin is configured to track a score of 10-90.

Supported embodiments include any of the foregoing methods, wherein the game board is one of the ten game board, each of the game board is designated by a number selected from 0 to 9 on the square that is on the top left corner of the 7 square by 7 square grid.

Supported embodiments include any of the foregoing methods, wherein the game boards include at least one of a multicolor game board and a black and white game board.

Supported embodiments include any of the foregoing methods, wherein one of the game actions includes keeping track of time available for a game call on a timer with the timer having an hourglass configured to keep track of 30 seconds.

Supported embodiments include any of the foregoing methods, wherein the game board cartridge comprises a 7 square by 7 square grid that is marked from 1 to 49.

Supported embodiments include any of the foregoing methods, wherein one of the game actions includes collecting the at least 40 game tiles by removing the game board from the cartridge grid and allow the game tiles to fall through the game board grid onto the game board trap area.

Supported embodiments include any of the foregoing methods, wherein one of the game actions includes subtracting a score point from a player during catch call in which the player announced a score point that is higher than the differences between the score point and the sum of differences of numbers between at least two of the game tiles connected diagonally on the game board.

Supported embodiments include any of the foregoing methods, wherein one of the game actions includes further eliminating a player when the score point is below 0.

Supported embodiments include an apparatus, a kit, and/or means for implementing the foregoing systems, methods, or a portion thereof.

It is to be understood that the configurations and/or approaches described herein are exemplary in nature, and that the described embodiments, implementations and/or examples are not to be considered in a limiting sense, because numerous variations are possible.

The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A system for a mechanical-mathematical diagonal number board game comprising:

a game timer;

a game board cartridge;

a plurality of game boards for inserting into the game board cartridge;

a plurality of numbered game tiles with each of the plurality of tiles having playing tile indicia corresponding to an integer selected within a range of 0 to 9;

a play base having a plurality of grids and plurality of timer spots for receiving the game timer with each grid having a plurality of holding cells for receiving one of the plurality of numbered game tiles;

a game board cartridge carrier for removably holding the game board cartridge with the game board cartridge receiving at least one of the plurality of game boards; and wherein the game board cartridge is positioned over the play base and can be rotated in relation thereto;

wherein each of the plurality of game boards is marked with a game board grid having a plurality of rows and columns forming a plurality of squares, with each of the plurality of squares having a game board indicia corresponding to an integer selected within the range of 0 to 9, and with none of the integers repeating within the same row, same column, or with respect to a connecting diagonal square; and wherein the plurality of tiles are drawn during game play, so that a player can make a diagonal connection to score points by matching the playing tile indicia with the game board indicia during a predetermined time period measured by the game timer.

2. The system of claim 1, further comprising:

a shaker bag for storing the plurality of playing tiles.

3. The system for claim 1, further comprising:

a score board; and a pair of score pins consisting of a first score pin and a second score pin;

wherein the first score pin is configured to track a score of 0-9, and the second score pin is configured to track a score of 10-90.

4. The system of claim 1, wherein the plurality of game boards includes ten game boards.

5. The system of claim 1, wherein each of the plurality of game tiles is a pyramid-shaped game piece.

6. The system of claim 1, wherein the game board grid includes an arrangement of squares formed in seven rows and seven columns and a plurality of unused squares.

7. The system of claim 1, further comprising:

a mechanical swivel device.

8. The system of claim 1, wherein the plurality of game boards includes multicolor game boards, black and white game boards, or both types of game boards.

9. The system for claim 1, wherein the game timer in hourglass-shaped container having a sufficient amount of sand contained therein for a predetermined period of thirty seconds.

10. The system of claim 1, wherein the game board cartridge includes a cartridge grid and the game board cartridge carrier is configured to allow the plurality of game tiles to fall through the cartridge grid.

* * * * *